US008418643B2

(12) United States Patent
Povich

(10) Patent No.: US 8,418,643 B2
(45) Date of Patent: Apr. 16, 2013

(54) TELESCOPING BOAT RAILING

(76) Inventor: Nathan David Povich, Washington, DC (US)

( * ) Notice: Subject to any disclaimer, the term of this patent is extended or adjusted under 35 U.S.C. 154(b) by 374 days.

(21) Appl. No.: 12/923,756

(22) Filed: Oct. 6, 2010

(65) Prior Publication Data

US 2011/0100287 A1 May 5, 2011

Related U.S. Application Data

(60) Provisional application No. 61/272,747, filed on Oct. 29, 2009.

(51) Int. Cl.
*B63B 17/04* (2006.01)

(52) U.S. Cl.
USPC ..... 114/364

(58) Field of Classification Search ..... 114/343, 114/364; 256/59, 65.01, 65.02, 65.04, 65.08, 256/65.11, 65.12, 65.15, 67, 72, 73; 49/55, 49/404–459; D28/48.5; 16/86.1; 292/65.02, 292/57–59; 403/109.1, 377
See application file for complete search history.

(56) References Cited

U.S. PATENT DOCUMENTS

| | | | | |
|---|---|---|---|---|
| 2,701,927 | A | 2/1955 | Dyer | |
| 2,736,904 | A | 3/1956 | Suggs | |
| 3,757,894 | A | 9/1973 | Chamberlin | |
| 3,999,673 | A | 12/1976 | Anderson | |
| 4,208,038 | A * | 6/1980 | Reid | 256/67 |
| 4,440,206 | A | 4/1984 | Dart | |
| 4,462,485 | A | 7/1984 | Terry et al. | |
| 4,475,840 | A | 10/1984 | Schmitt et al. | |
| 4,619,548 | A | 10/1986 | Kazaoka et al. | |
| 4,712,503 | A | 12/1987 | Ritten | |
| 4,719,989 | A | 1/1988 | Ritten | |
| 4,742,795 | A | 5/1988 | De Prey et al. | |
| 4,854,534 | A | 8/1989 | Porter | |
| 5,014,640 | A | 5/1991 | Owen, Sr. | |
| 5,117,940 | A | 6/1992 | Garelick | |
| 5,195,767 | A | 3/1993 | Des Roches | |

(Continued)

FOREIGN PATENT DOCUMENTS

GB 2173527 10/1986

OTHER PUBLICATIONS

Advertisement for Preguard™ "Advanced Guardrail System" from Combisafe® Safety by Systems, 4 pp, date unknown.

(Continued)

*Primary Examiner* — Edwin Swinehart
(74) *Attorney, Agent, or Firm* — Staas & Halsey LLP

(57) ABSTRACT

A telescoping boat railing including a rod having a first end with a fastener and a second end that telescopes relative to an opening in a hollow top rail of a boat. The top rail is supported horizontally by one of a plurality of vertical support members of a railing for the boat, which railing defines an opening for accessing the boat. Across the railing opening from the fastener is a receptacle formed co-linearly with the fastener and extending from a horizontal portion of the top of the railing. The rod is pulled out of the opening in the top rail in the direction of the receptacle and is removably attached by connecting the fastener and the receptacle. To return the rod to its nested position, the fastener is disconnected from the receptacle, and the rod is telescoped back into its nesting position in the hollow of the top rail.

28 Claims, 14 Drawing Sheets

U.S. PATENT DOCUMENTS

| | | | |
|---|---|---|---|
| D336,280 | S | 6/1993 | Sparhawk |
| 5,269,044 | A | 12/1993 | Marion |
| 5,427,049 | A | 6/1995 | Mardikian |
| 5,433,551 | A | 7/1995 | Gordon |
| 5,499,595 | A | 3/1996 | Pollen |
| 5,520,140 | A | 5/1996 | Szukhent, Jr. |
| 5,537,948 | A | 7/1996 | Kobayashi |
| 5,586,516 | A | 12/1996 | Hagen et al. |
| 5,628,274 | A | 5/1997 | Biedenweg et al. |
| 5,970,905 | A | 10/1999 | Jaramillo, Sr. |
| 6,021,733 | A | 2/2000 | Jaramillo, Sr. |
| 6,098,566 | A | 8/2000 | Metcalf |
| 6,499,435 | B2 | 12/2002 | Markham |
| 6,508,190 | B1 | 1/2003 | Norton |
| 6,748,895 | B2 | 6/2004 | Besenzoni |
| 6,789,648 | B2 | 9/2004 | Cook |
| 6,840,825 | B1 | 1/2005 | Messano |
| 6,904,862 | B1 | 6/2005 | Chustak |
| 6,921,060 | B2 | 7/2005 | Weed, Jr. |
| 6,932,011 | B2 | 8/2005 | Nagata et al. |
| 6,932,020 | B2 | 8/2005 | Everett |
| 6,932,021 | B1 | 8/2005 | Martini |
| 6,968,801 | B2 | 11/2005 | Baker |
| 6,983,823 | B1 | 1/2006 | Zumbrunnen |
| 7,063,186 | B1 | 6/2006 | Granke |
| 7,182,175 | B1 | 2/2007 | Schmitt et al. |
| 7,293,521 | B1 | 11/2007 | Johns, Jr. et al. |
| 7,341,016 | B2 | 3/2008 | Terleski et al. |
| 7,409,921 | B1 | 8/2008 | Jones |
| 7,431,342 | B2 | 10/2008 | Sauer |
| 7,444,954 | B1 | 11/2008 | Resta |
| 7,503,276 | B1 | 3/2009 | Curi et al. |
| 7,527,015 | B1 | 5/2009 | Peter |
| 2004/0188667 | A1 | 9/2004 | Ray et al. |

OTHER PUBLICATIONS

*Cruising World* Magazine, Apr. 2010, cover page and pp. 7, 8, 11, 14 and 58-62.

* cited by examiner

TELESCOPING BOAT RAILING

CROSS REFERENCE TO RELATED APPLICATION

This application claims the benefit under 35 U.S.C. Section 119(e) of U.S. Provisional Patent Application Ser. No. 61/272,747, entitled TELESCOPING BOAT RAILING, filed Oct. 29, 2009, which is hereby incorporated by reference in its entirety into this application.

BACKGROUND OF THE INVENTION

The invention relates to a railing device and, more particularly, to a sailboat deck railing.

Conventionally, a sailboat deck is surrounded by a railing made of horizontal stainless steel tubes and/or cables supported in spaced, parallel relation by vertical members. The railing prevents people and objects from falling overboard and allows people to move about the boat while holding onto the rail.

Such a railing can be interrupted by an opening defined by two of the spaced vertical support members by which people can get onto and off of the boat, supplies can be loaded, etc. This opening is usually closed by a top rail piece that is supported by and pivots relative to one of the vertical support members to which it is attached at one end. The other end of the top rail piece fits down into a receptacle or is otherwise fastened to the other vertical support member defining the opening. Alternatively, a cable might extend between and be removably fastened to the spaced support members.

Such conventional top rails or cables are not very strong or stable, may come lose, and may be difficult to attach/remove, especially for those unfamiliar with sailboats.

SUMMARY OF THE INVENTION

Accordingly, it is a purpose of the present invention to provide a railing that is easy to engage and disengage.

It is another purpose of the present invention to provide a railing that is easily extended into place to reliably and securely close off an opening, and which can also be easily retracted to allow access through the opening, thereby avoiding any need to carry and install a separate gate.

It is still another purpose of the present invention to provide a sailboat railing which can withstand environmental elements, but operate repeatedly in reliable fashion to allow or deny access to an opening on the sailboat, as desired, thereby providing a long useful life at reasonable cost.

It is a further purpose of the present invention to provide a sturdier, movable rail for a sailboat than is known in the art.

It is also a purpose of the present invention to provide a sailboat railing that can be telescoped into position to close off an opening and can be telescoped out of the way when access the opening is desired, thereby saving space on the boat.

To achieve the foregoing and other purposes of the present invention there is provided a rod having a first end with a fastener and a second end that telescopes relative to an opening in a hollow top rail of a boat. The top rail is supported horizontally by one of a plurality of vertical support members of a railing for the boat, which railing defines an opening for accessing the boat. Across the railing opening from the fastener is a receptacle formed co-linearly with the fastener and extending from a horizontal portion of the top of the railing. In order to close the opening in the railing, the rod is pulled out of the opening in the top rail in the direction of the receptacle which is co-linear therewith. The rod is removably attached to the receptacle by connecting the fastener and the receptacle, e.g., via a screw thread. To return the rod to its nested position, the fastener is disconnected from the receptacle, and the rod is telescoped back into its nesting position in the hollow of the top rail.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
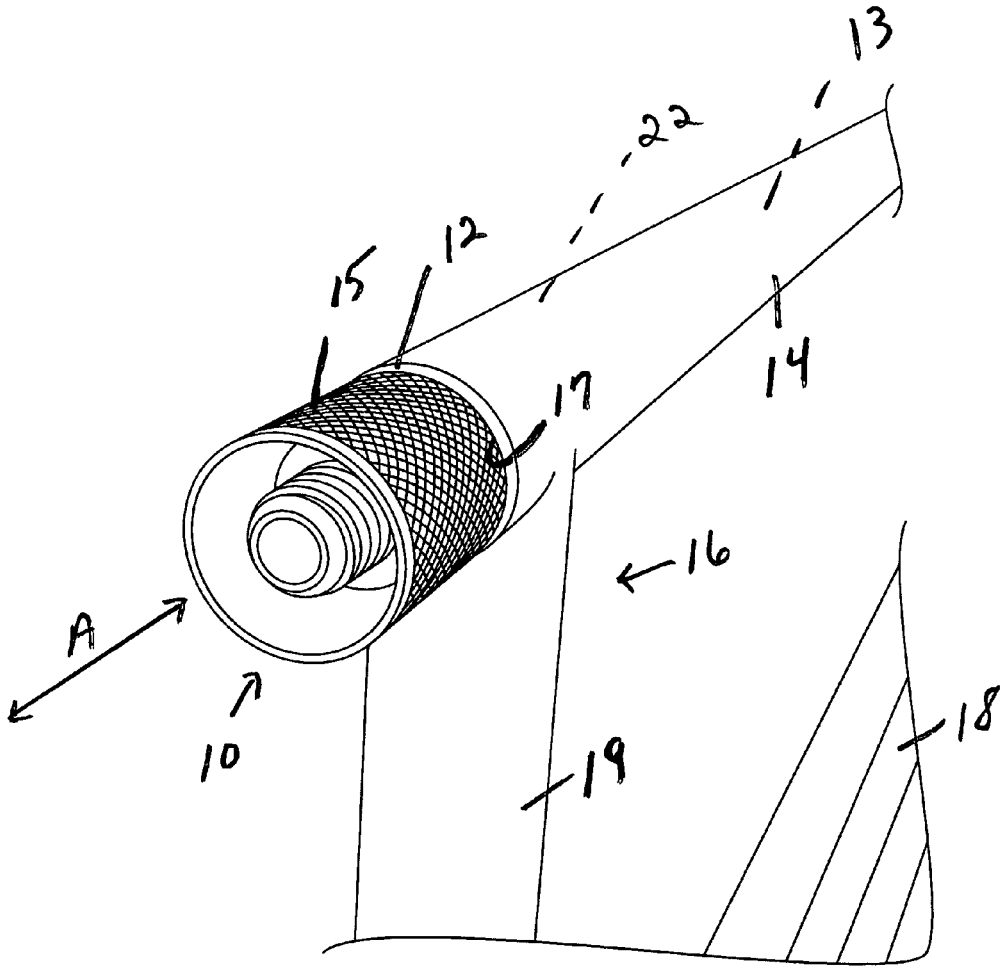
FIG. 1 is a perspective view of the telescoping railing of the present invention with a rod thereof in a nesting position.

The present invention relates to a movable and easier to use railing to facilitate access. More particularly, as shown particularly in FIGS. 1-4, the present invention relates to telescoping rail 1 preferably for a sailboat. The telescoping rail 1 includes a railing 16 having a rod 22 with a free end 12. A connecting member, e.g., a fastener 10, is formed at the free end. The rod 22 also includes a second end 13 within an opening 17 in a hollow top rail 14. The fastener 10 can be fixed to the rod 22, and the rod 22, so that the fastener 10 is rotatable with the rod 22 relative to the top rail 14. The rod 22 can telescope relative to the top rail 14.

When the invention is used on a boat, water, mist or other condensation often accumulates on the railings 16. The fastener 10 of the present invention has a roughened outer surface 15 to help the user grasp the fastener 10 to pull the rod 22 out of its nesting position (FIG. 1) in the top rail 14, when desired. See particularly FIGS. 1 and 4. The fastener 10 also preferably includes a threaded male member 11, as also shown, e.g., in FIGS. 1 and 4.

The rod 22 is preferably made of stainless steel to withstand the potentially damaging environment in which the rod 22 would be used outdoors, e.g., salt air and water which would lead to tarnishment and deterioration of other metals. Being made of stainless steel also provides the strength to restrain people of objects that might come into contact therewith. Stainless steel can also be fashioned into the rod 22 to include a fastener 10 thereon. Wood, hard plastic or other materials that can withstand the elements, provide adequate strength, and which allow themselves to be configured with a fastener could be used.

Figure 2:
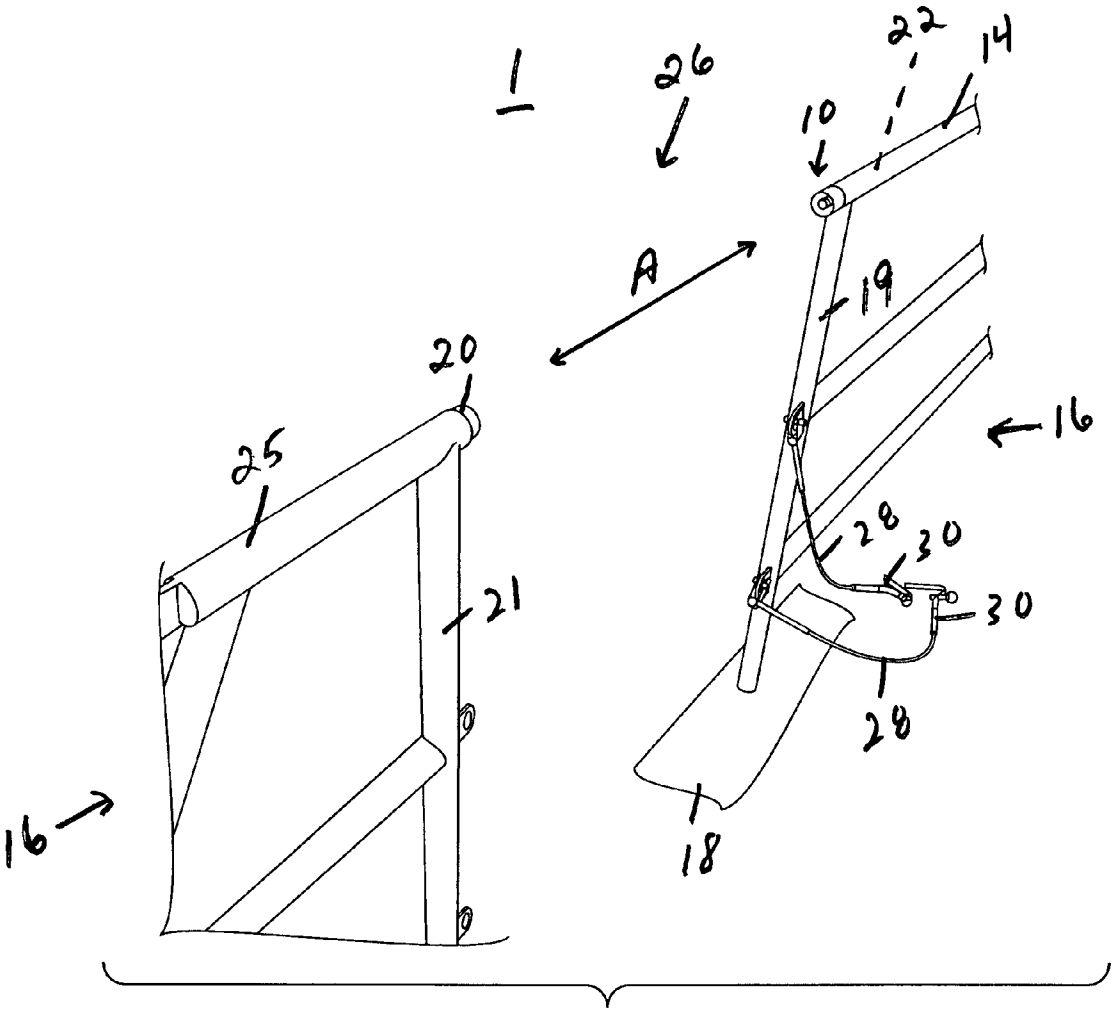
FIG. 2 is a perspective view of an opening formed in the railing of a boat between two support.
Figure 3:
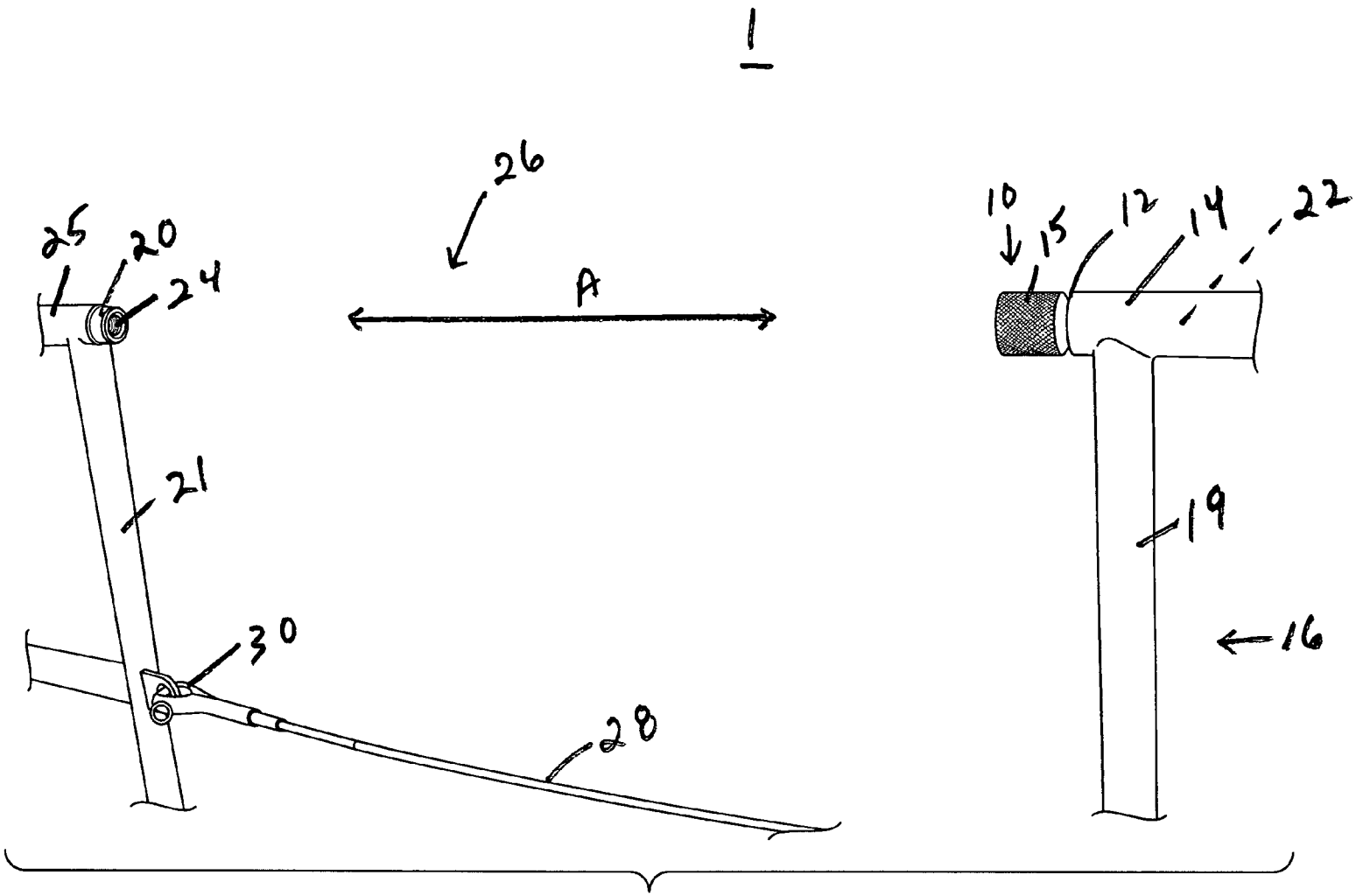
FIG. 3 is another perspective view of the opening in the railing.
Figure 4:
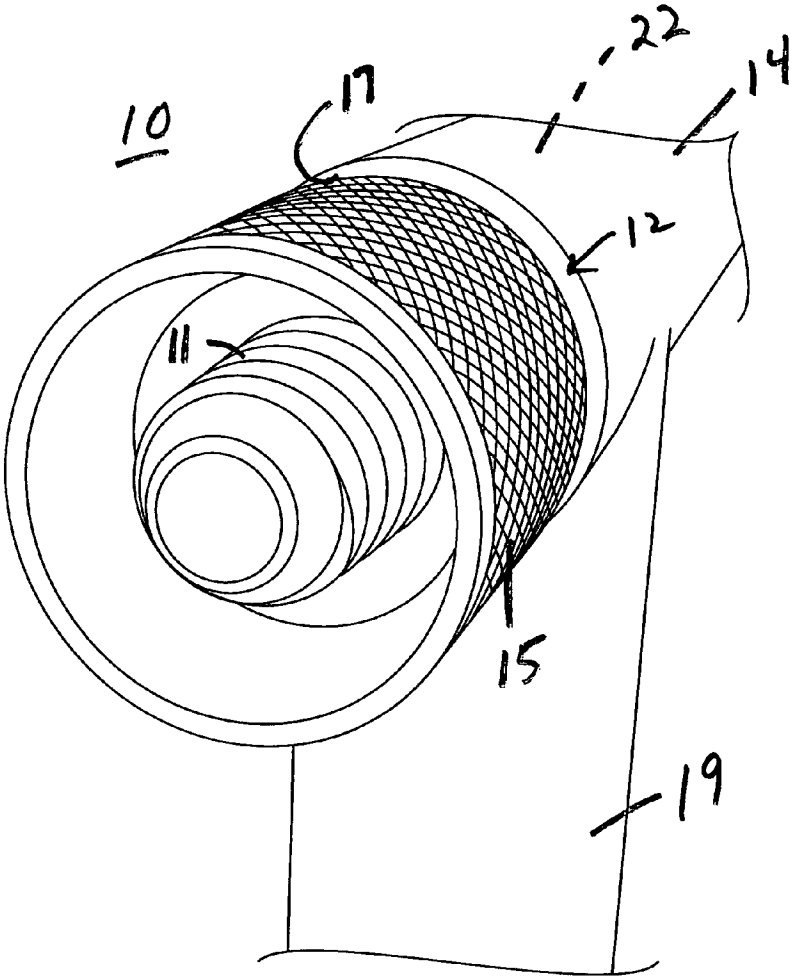
FIG. 4 is a perspective view of a fastener on a free end of a top rod in the railing.
Figure 5:
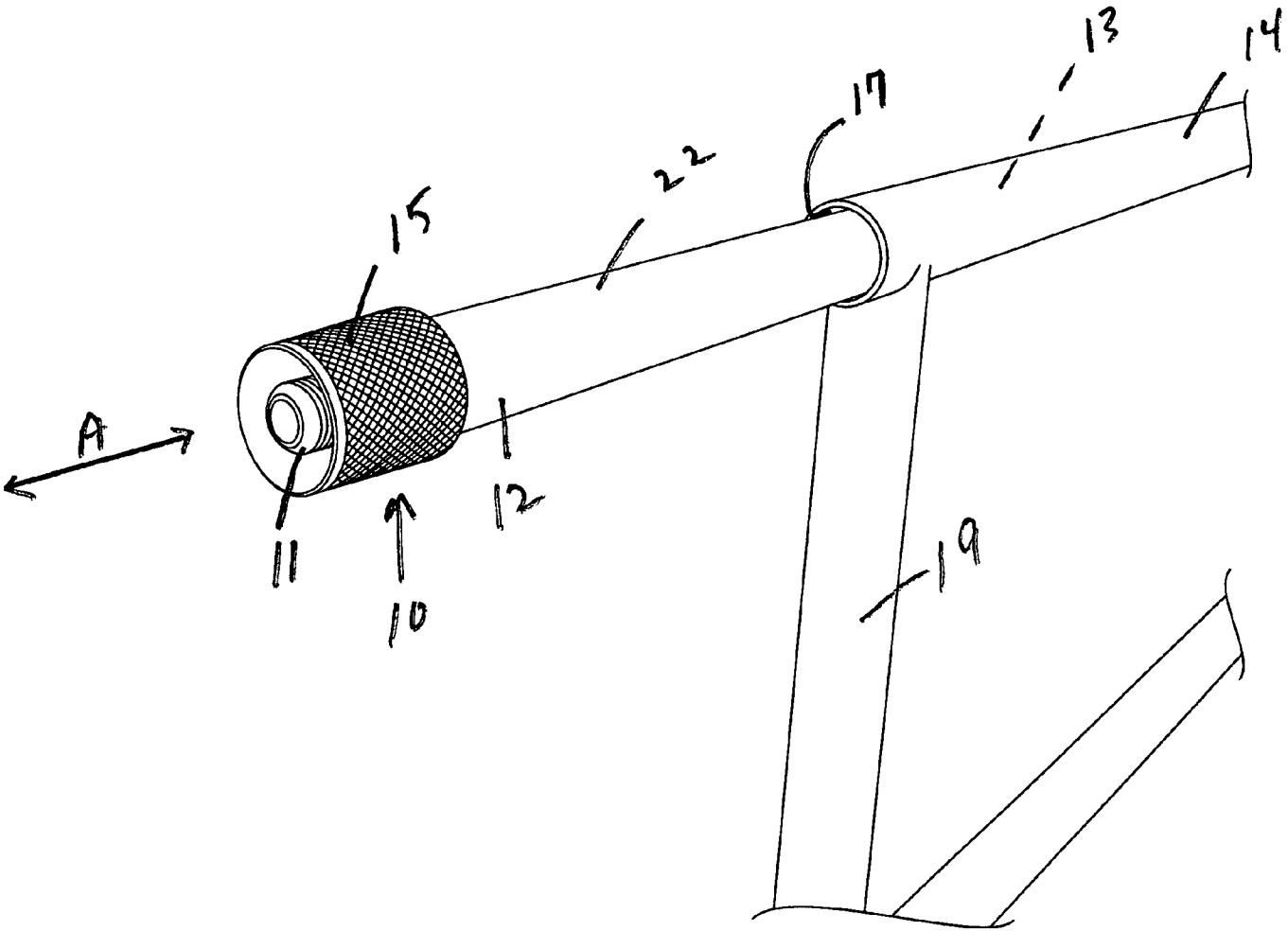
FIG. 5 is a perspective view of the rod telescoping out of the top rail from the nesting position shown in FIG. 1 toward an opposing support.
Figure 6:
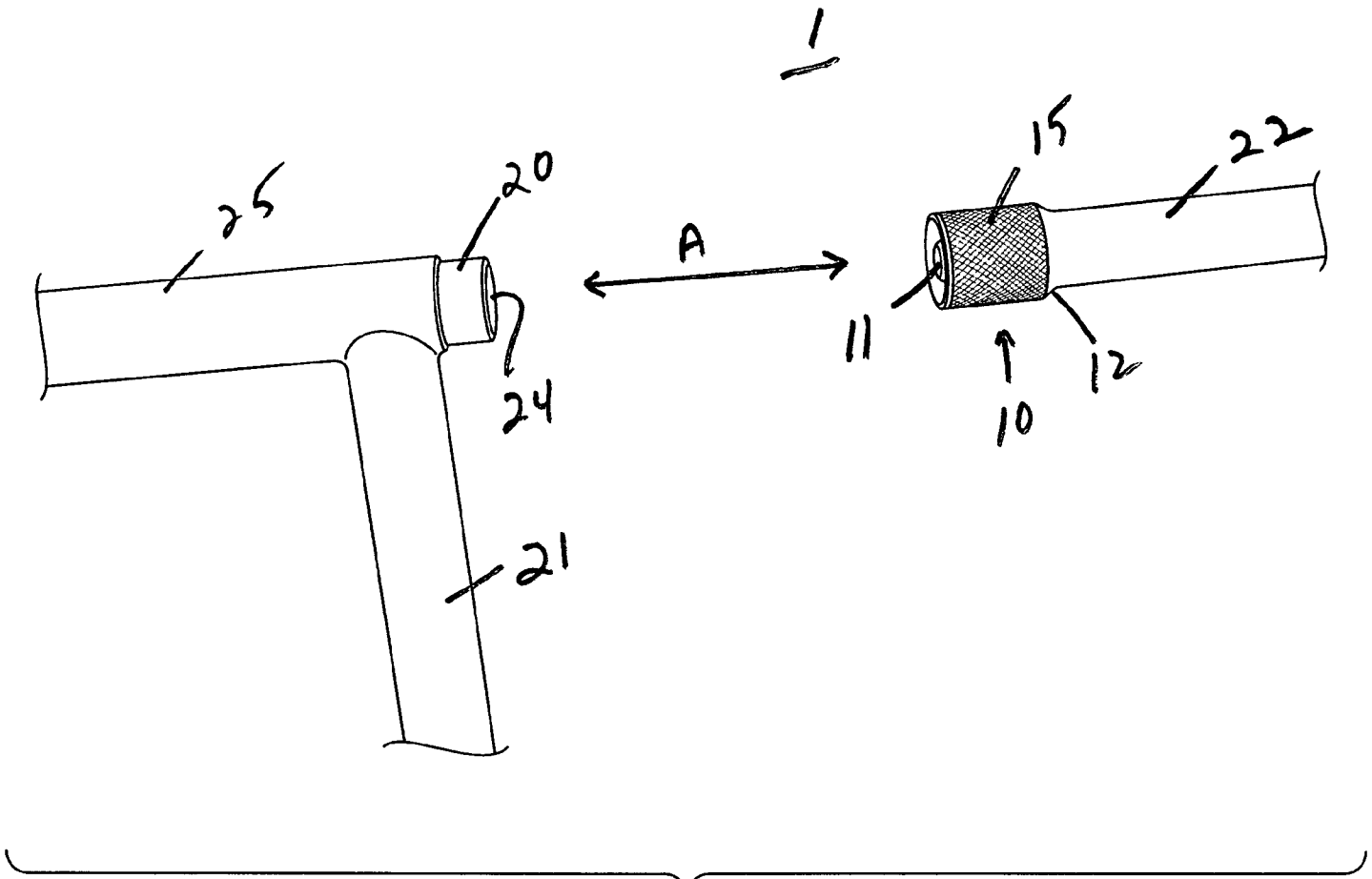
FIG. 6 is a side view of the rod telescoping toward the opposing support.
Figure 7:
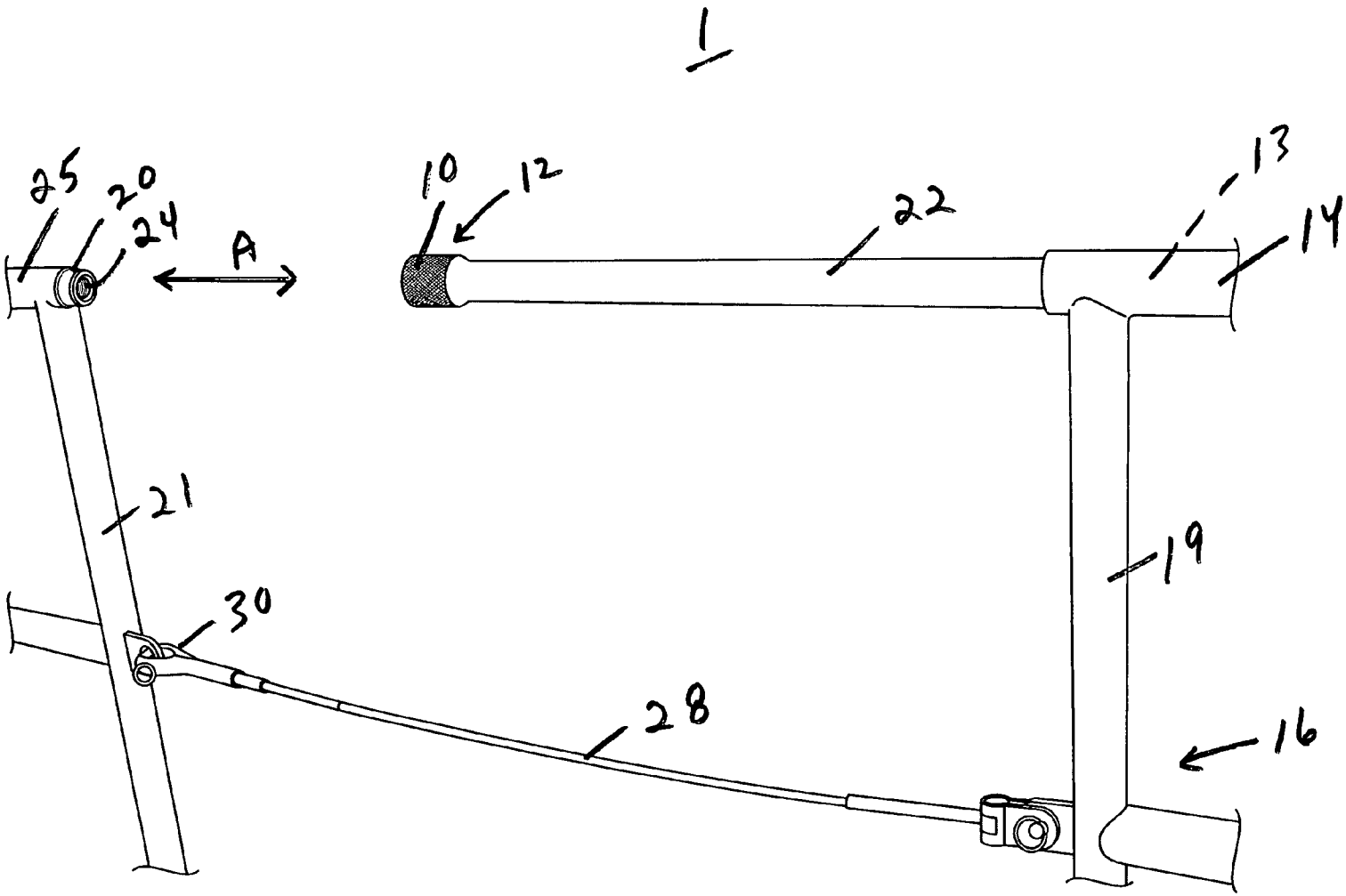
FIG. 7 is a perspective view of the telescoping rod.

The top rail 14 is supported horizontally by at least one vertical support member 19 of the railing 16, as shown, e.g., in FIGS. 2, 5 and 7, which is attached to the deck 18 of the boat. The vertical support member 19 and an adjacent support member 21 of the railing 16 defines the opening 26 shown, e.g., in FIGS. 2, 3, and 7.

The length of the rod 22 is at least longer than the opening 26 formed in the railing 16. The outer diameter of the rod 22 is slightly less than the inner diameter of the hollow top rail 14, which allows the rod 22 to telescope freely relative to the hollow top rail 14.

As shown in FIGS. 3, 7, 9 and 10, across the opening 26 from the rod 22 and fastener 10 is a receptacle 20 formed co-linearly with the rod 22 and fastener 10 to extend from a horizontal rail 25 of the top of the railing 16, which rail 25 is supported by the vertical support member 21. The receptacle 20 preferably includes a female threaded member 24.

In order to close the opening 26, the rod 22 is first grasped at the roughened surface 15 of the fastener 10 when in the nested position shown in FIGS. 1-4. The rod 22 is then pulled away linearly from the hollow top rail 14 opening 17 in the direction of the receptacle 20, as shown by axis "A" in FIGS. 5-8.

The fastener 10 is moved into engaging contact with the receptacle 20. That is, as the fastener 10 is brought into contact with the receptacle 20, the rod 22 is rotated relative to the rail 14, which causes the threads of the male-threaded member 11 and the threads of the female-threaded member 24, respectively, to engage. The rod 22 is preferably rotated until the threads of the fastener 10 and receptacle 20 are fully engaged. The rod 22 is thus securely fixed in place to close off the opening 26.

Figure 12:
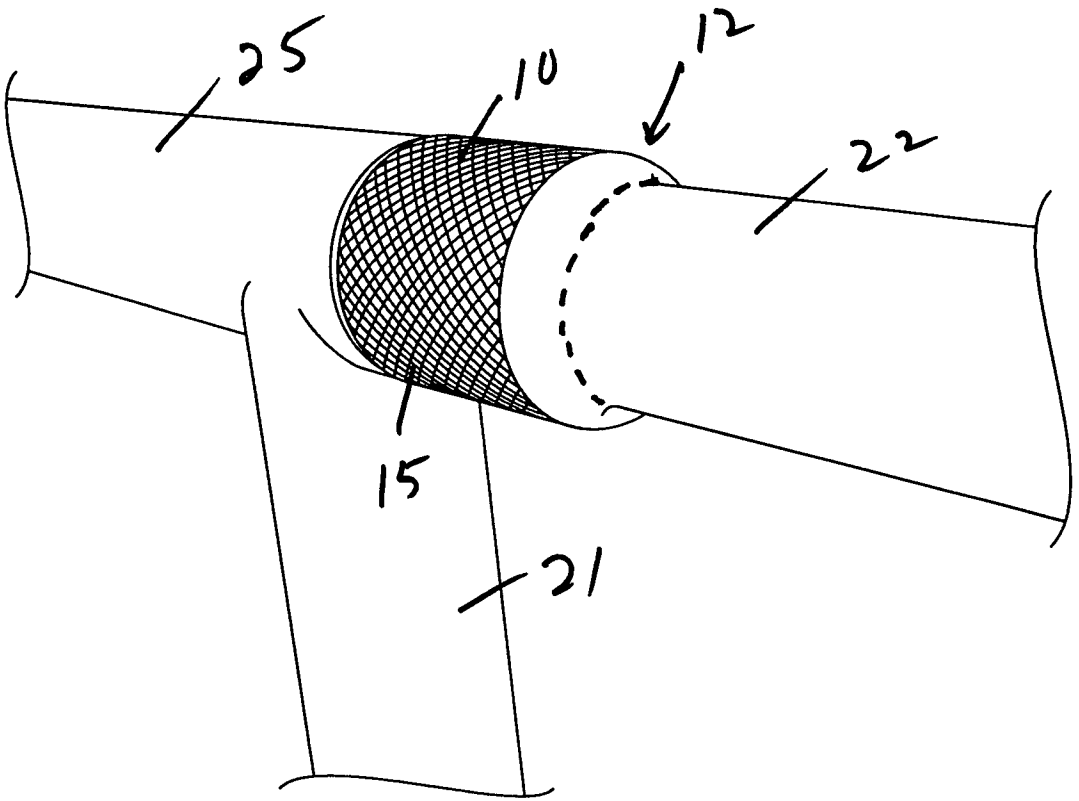
FIG. 12 is another perspective view of the fastener threaded onto the receptacle.
Figure 13:
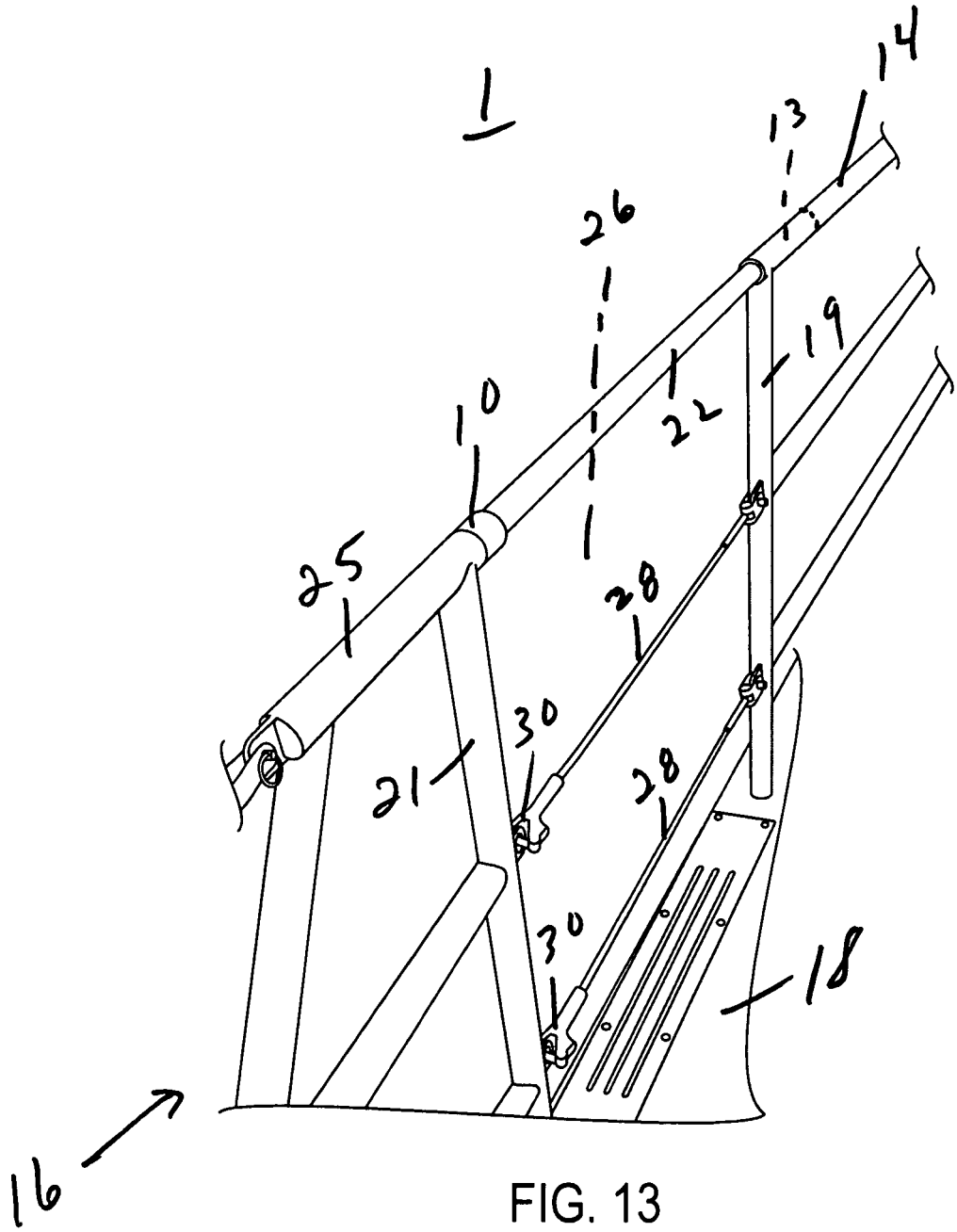
FIG. 13 is a perspective view of the secured rod closing off the opening, looking from the deck of the boat.

As noted above, preferably the fastener 10 is fixed to the rod 22, and the rod 22 is rotatable relative to the rail 14. Alternatively, the fastener 10 could be a separate member rotatably formed on the rod 22, as shown by the broken lines in FIG. 12. That is, the fastener 10 could be a member that is essentially non-removably but rotatably attached via, e.g., interfering collars formed on the rod 22 and the fastener 10, much like a water hose threaded connector, or a central bolt, etc., so that the fastener 10 can be rotated to engage the threads but the fastener 10 cannot be removed from the rod 22. Again, the fastener 10 could include a roughened surface 15 to facilitate grasping and rotation.

Figure 8:
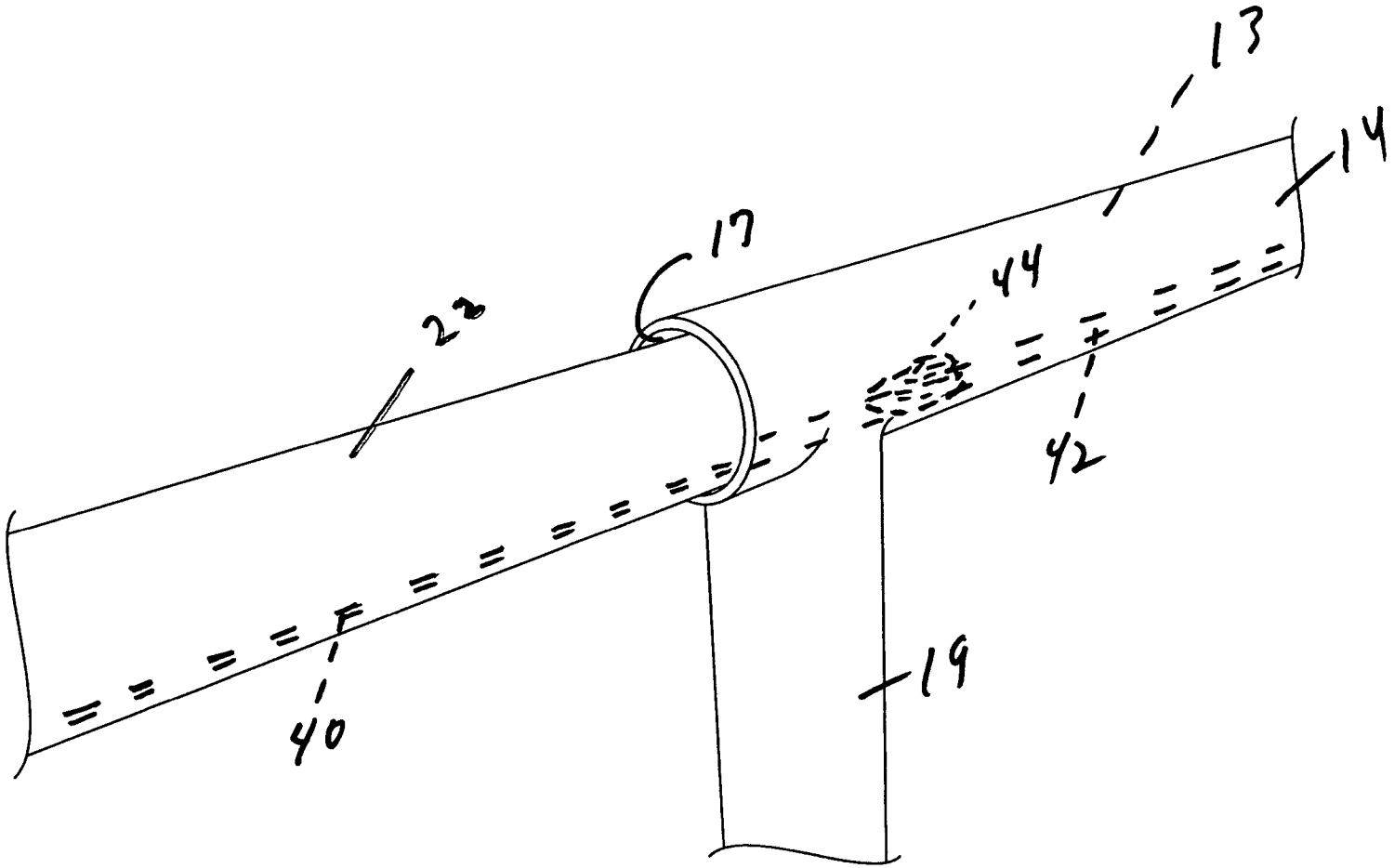
FIG. 8 is a perspective view of cooperating members formed on the rod and the top rail.
Figure 9:
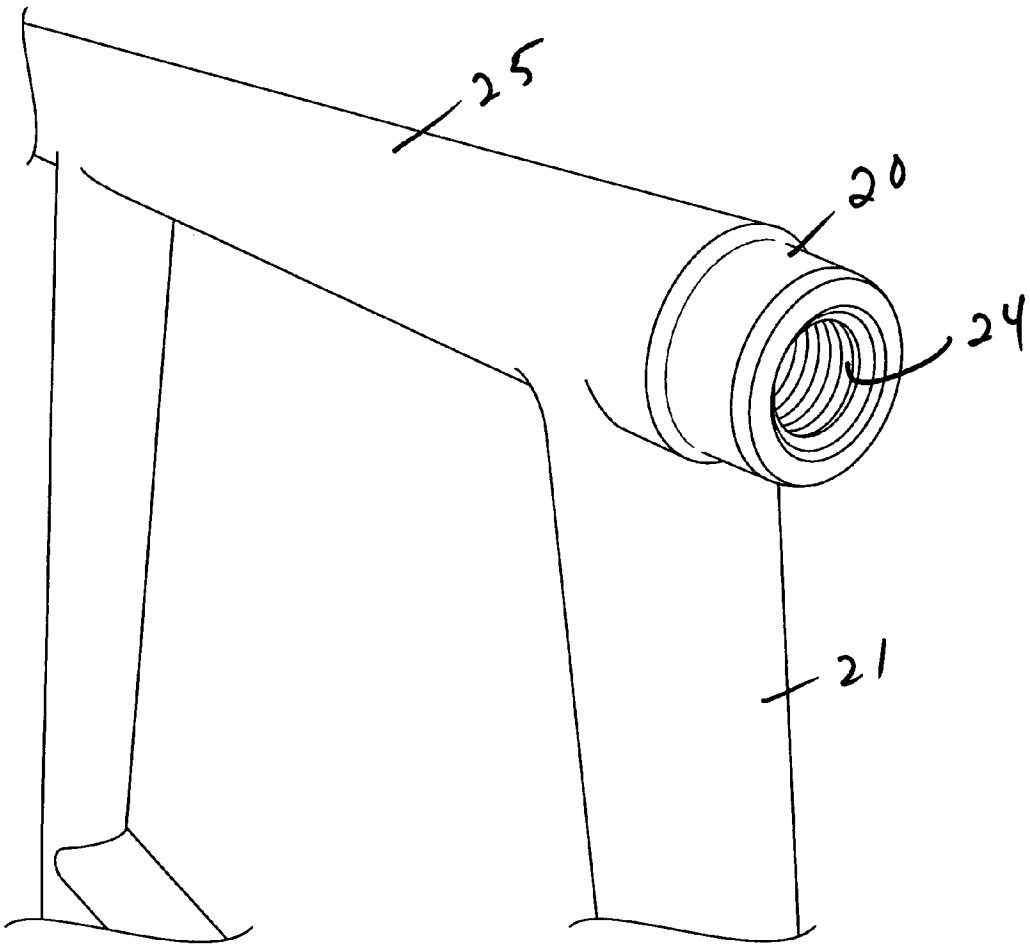
FIG. 9 is a perspective view of a receptacle at the opposing support.
Figure 10:
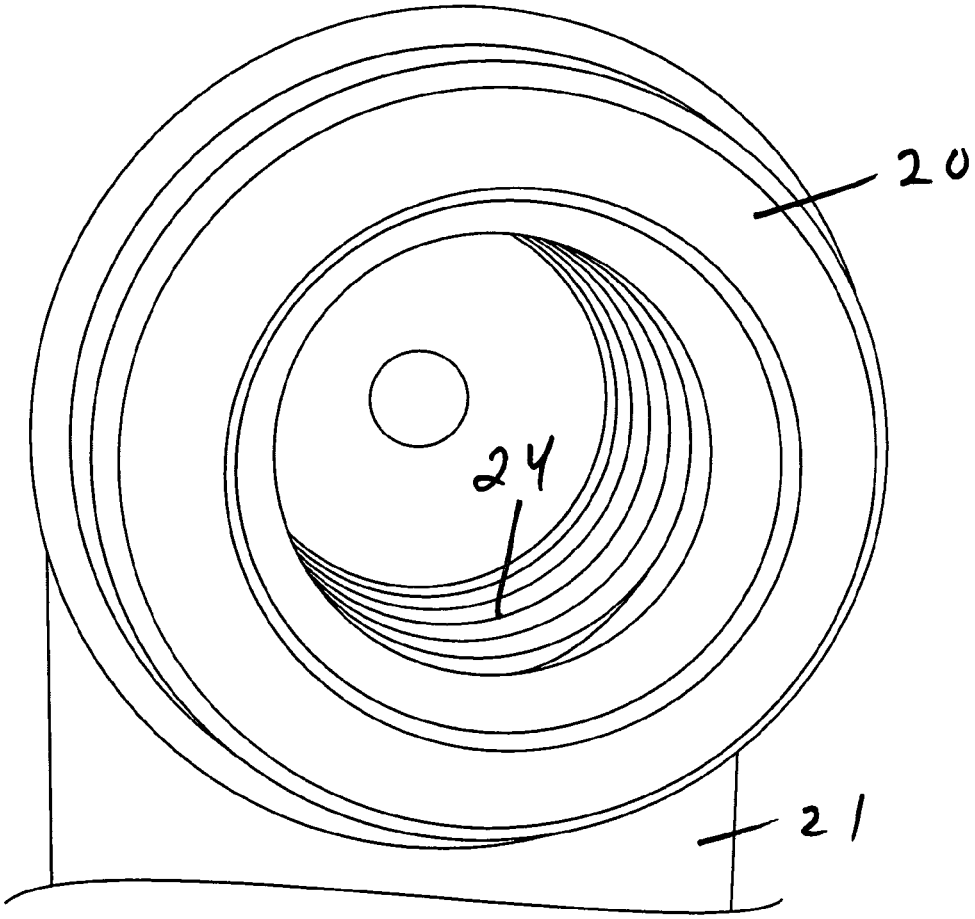
FIG. 10 is a front perspective view of the receptacle.
Figure 11:
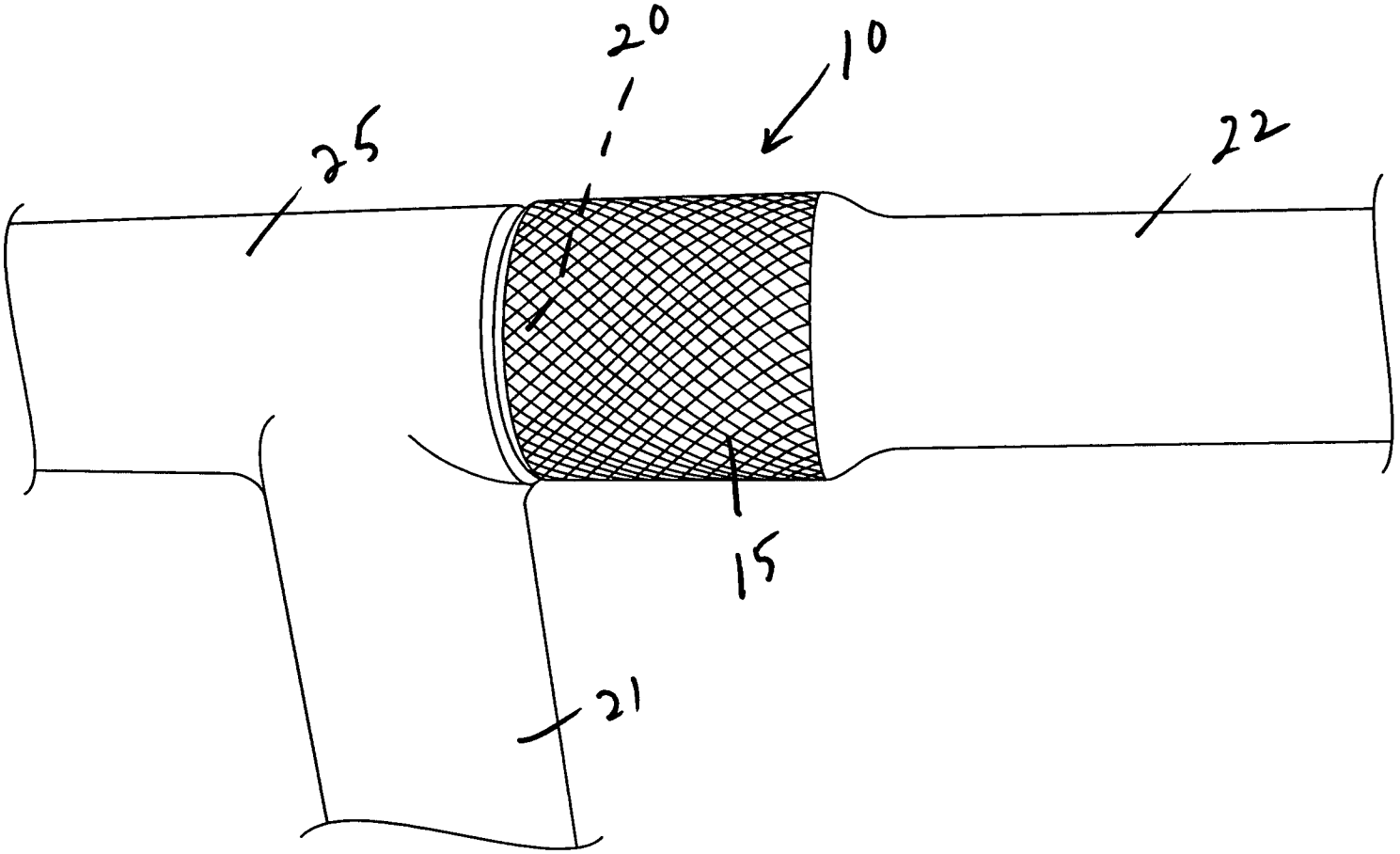
FIG. 11 is a perspective of the fastener threaded onto the receptacle.

Also, in such an alternative embodiment the rod 22 might include cooperating members, e.g., linear, longitudinally spaced, side grooves 40 on the rod 22 and the top rail 14 and corresponding linear projections 42 on the rail 14, as shown in FIG. 8, to facilitate guidance of the rod 22 in and out of the top rail 14, and to prevent rotation of the rod 22 relative to the hollow rail 14. Of course, the positions of the grooves and projections could be reversed. Further, some type of lubricant 44 could be used to facilitate the movement of the rod 22 from the nesting to the fully extended position as shown, e.g., in FIG. 8. As such, the rod 22 would not rotate relative to the top rail 14, but the fastener 10 would, as suggested above.

When so fastened, the telescoping rail 1 of the present invention is strong and does not come lose, but is easy to disengage, even by someone not particularly familiar with sailboats. The rod 22 is usually kept secured in the fully extended position to close the opening 26, and is usually only moved to its nesting position when people are boarding or supplies are being loaded onto or removed from the boat.

When in its nested position (e.g., FIG. 1), the rod 22 does not have a tendency to slide toward its closed position (FIGS. 11-14), due to the weight of the rod and the nesting orientation. When the boat is underway, and the boat is expected to undergo significantly more movement than when docked, the rod 22 is in the extended, engaged position (FIGS. 11-14), and does not move.

To return the rod 22 to its nested position shown in FIG. 1, the above steps are merely reversed. That is, the fastener 10 is again grasped at the roughened outer surface, and rotated to disengage the threaded connection between the fastener 10 and the receptacle 20. Once the threaded connection is disengaged, the rod 22 is slid back along axis A into its nesting position in the top rail 14.

In its nesting position, the rod 14 is out of the way, so it does not impede movement about the opening 26 and does not take up additional space. This is in contrast to pivoting bars or gates used to close openings that are known in the art, which rest against the railing.

As can be seen, the telescoping rail 1 is easy to use, even in a watery environment, and even by someone who is not familiar with boats, saves space and provides adequate strength to restrain people and objects, when desired.

Other illustrative alternative embodiments of the present invention are described below.

As would be understood by one of ordinary skill, the fastener 10 could instead include a female thread, and the receptacle 20 could include a male thread.

Also, other means than a screw thread could be used to reliably hold the rod 22 in the extended position to the receptacle 20, and to allow reliable release when the top rail 14 needs to be returned to its nesting position. Examples include spring-loaded projection(s), much like on a patio umbrella, and other interference fits, a strong magnet, etc. However, the receipt of the rod 22 relative to the receptacle 20 should be secure and should not become disengaged by movement of the boat, or when people or objects bump into the rod. Accordingly, magnets would not be a preferred means for connecting the rod 22.

Also, the receptacle 20 can be rotatably mounted to the horizontal rail 25. In this way, when the fastener 10 engages the receptacle 20, the receptacle 20 can be rotated to connect the rod 22. In this case, the receptacle 20 can include a roughened surface to facilitate grasping of the receptacle 20.

Figure 14:
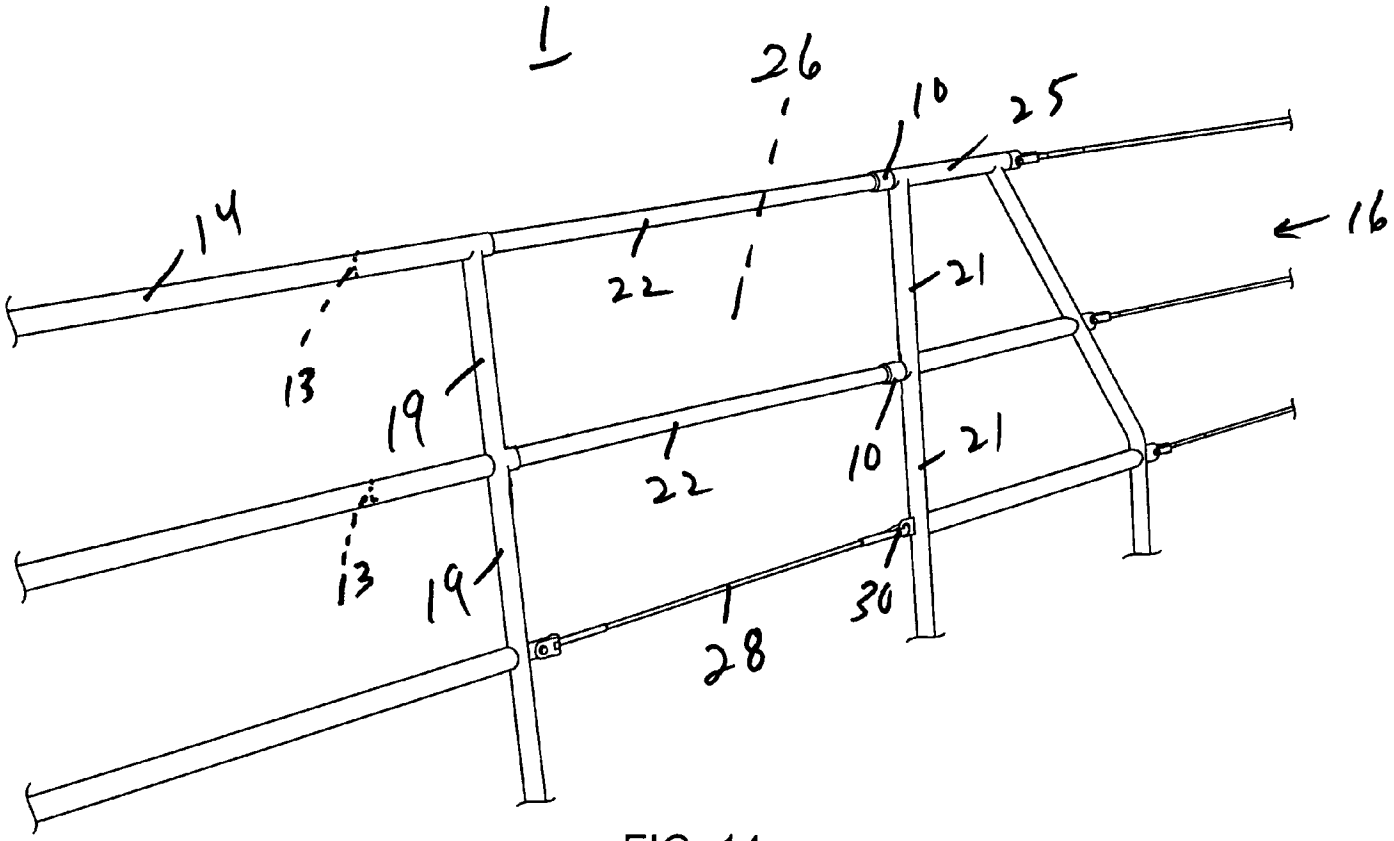
FIG. 14 is another perspective view showing the secured rod, looking from outside the boat.

Since the uppermost rails, in this case 14, 25 and 22, of the railing 16 are the most important for support for people moving about the boat, and to prevent objects from going overboard, conventional, less expensive removable cables 28 with moveable spring-loaded metal clips 30, or the equivalent, can be used to close off the rest of the opening 26. Thus, usually one rod 22 at the upper position and two such cables 28 at a lower position would be used at each opening 26. These cables 28 can be removed, and the telescoping rod 22 put into its nesting position when it is necessary to provide access to the boat via the opening 26. Of course, any of such cables could be replaced with telescoping rails 1 of the present invention, as shown in FIG. 14, although this would increase costs.

The foregoing is considered illustrative only of the principles of the invention. Further, since numerous modifications and changes will readily occur to those skilled in the art, it is not desired to limit the invention to the exact construction and operation shown and described. For example, while the above describes a rod that nests within a rail, the reverse can provide the same function, i.e., the rod could be hollow and move telescopically around the rail therewithin. Also, while the above embodiments are described as being particularly appropriate for sailboats, the telescoping railing of the present invention can also be used for railings for other types of boats, and for other railing purposes where a temporary opening is needed, e.g., on a dock. Further, the rod 22 can be telescoped from either side of the opening, i.e., left or right. Accordingly, all suitable modifications and equivalents may be resorted to that fall within the scope of the invention and the appended claims.

What is claimed is:

1. A railing, comprising:
a first support;
a first rail supported by the first support;
a first rod in a telescoping relationship with the first rail,
wherein the rod has a free end having a first connecting member;
a second support spaced from the first support to define an opening between the first and second supports,
wherein the second support includes a second connecting member, and
wherein the rod is movable between a first position, wherein the rod and the rail are in a nested relationship, and a second extended position, wherein the first and second connecting members are removably connected; and
a cable removably extended between the first and second supports.

2. The railing recited in claim 1, wherein the first connecting member is a screw-threaded fastener and the second connecting member is a screw-threaded receptacle.

3. The railing recited in claim 1, wherein the first connecting member is externally roughened.

4. The railing recited in claim 1, wherein the first connecting member is rotatable relative to the rod.

5. The railing recited in claim 1, wherein the second connecting member is rotatable relative to the second support.

6. The railing recited in claim 1, wherein the rod is stainless steel.

7. The railing recited in claim 1, wherein the first connecting member is stainless steel.

8. The railing recited in claim 1, wherein the rod is rotatable relative to the rail.

9. The railing recited in claim 1, further comprising cooperative members formed between the rail and the rod for linearly guiding the rod between the first and second positions, and for preventing rotation of the rod relative to the rail.

10. The railing recited in claim 9, further comprising lubricant on the cooperating members.

11. The railing recited in claim 1, further comprising:
a second rail supported by the first support; and
a second rod in telescoping relation with the second rail;
wherein the second rail has a free end having a third connecting member,
wherein the second support includes a fourth connecting member, and
wherein the second rod is movable between a first position, wherein the second rod and the second rail are in a nested relationship, and a second extended position, wherein the third and fourth connecting members are connected.

12. A sailboat railing, comprising:
a first support;
a first hollow rail supported by the first support;
a first rod received telescopically within the hollow rail,
wherein the rod has a free end with a first threaded connecting member;
a second vertical support spaced from the first support to define an opening between the first and second supports,
wherein the first connecting member, the second connecting member and the rod are co-linear,
wherein the second support includes a second threaded connecting member, and
wherein the rod is movable between a first position, wherein the rod is nested in the hollow rail, and a second extended position, wherein the first and second connecting members are screw connected; and
a cable removably extended between the first and second supports.

13. A sailboat railing, comprising:
a first vertical support;
a first hollow rail supported horizontally by the first vertical support;
a first linear rod received telescopically and rotatably within the hollow rail,
wherein the rod has a free end with a first male threaded connecting member fixed to the free end;
a second vertical support spaced from the first support to define an opening between the first and second supports,
wherein the second support includes a second threaded female connecting member, and
wherein the rod is movable horizontally between a first position, wherein the rod is nested in the hollow rail, and a second extended position, wherein the first and second connecting members are screw connected; and
a cable removably extended between the first and second supports.

14. A sailboat railing, comprising:
a first vertical support on a sailboat deck;
a first hollow, horizontal rail supported by the first support;
a first rod received telescopically and rotatably within the hollow rail,
wherein the rod has a free end with a first male threaded connecting member fixed internally to the free end and the free end is roughened externally;
a second vertical support on a sailboat deck and spaced from the first support to define an opening between the first and second supports,
wherein the second support includes a second threaded female connecting member internally thereof, and
wherein the rod is movable linearly between a first position, wherein the rod is nested in the hollow rail, and a second extended position, wherein the first and second connecting members are removably screw connected; and
a cable removably extended between the first and second supports.

15. A railing, comprising:
a first support;
a first rail supported by the first support;
a first rod in a telescoping relationship with the first rail,
wherein the rod has a free end having a first connecting member;
a second support spaced from the first support to define an opening between the first and second supports,
wherein the second support includes a second connecting member, wherein the rod is movable between a first position, wherein the rod and the rail are in a nested relationship, and a second extended position, wherein the first and second connecting members are removably connected, and wherein the rod is longer than the opening formed between the first and second supports.

16. The railing recited in claim 15, wherein the first connecting member is a screw-threaded fastener and the second connecting member is a screw-threaded receptacle.

17. The railing recited in claim 15, wherein the first connecting member is externally roughened.

18. The railing recited in claim 15, wherein the first connecting member is rotatable relative to the rod.

19. The railing recited in claim 15, wherein the second connecting member is rotatable relative to the second support.

20. The railing recited in claim 15, wherein the rod is stainless steel.

21. The railing recited in claim 15, wherein the first connecting member is stainless steel.

22. The railing recited in claim 15, wherein the rod is rotatable relative to the rail.

23. The railing recited in claim 15, further comprising cooperative members formed between the rail and the rod for linearly guiding the rod between the first and second positions, and for preventing rotation of the rod relative to the rail.

24. The railing recited in claim 23, further comprising lubricant on the cooperating members.

25. The railing recited in claim 15, further comprising:

a second rail supported by the first support; and a second rod in telescoping relation with the second rail;

wherein the second rail has a free end having a third connecting member, wherein the second support includes a fourth connecting member, and wherein the second rod is movable between a first position, wherein the second rod and the second rail are in a nested relationship, and a second extended position, wherein the third and fourth connecting members are connected.

26. A sailboat railing, comprising:

a first support;

a first hollow rail supported by the first support;

a first rod received telescopically within the hollow rail, wherein the rod has a free end with a first threaded connecting member;

a second vertical support spaced from the first support to define an opening between the first and second supports, wherein the first connecting member, the second connecting member and the rod are co-linear, wherein the second support includes a second threaded connecting member, wherein the rod is movable between a first position, wherein the rod is nested in the hollow rail, and a second extended position, wherein the first and second connecting members are screw connected, and wherein the rod is longer than the opening formed between the first and second supports.

27. A sailboat railing, comprising:

a first vertical support;

a first hollow rail supported horizontally by the first vertical support;

a first linear rod received telescopically and rotatably within the hollow rail, wherein the rod has a free end with a first male threaded connecting member fixed to the free end;

a second vertical support spaced from the first support to define an opening between the first and second supports, wherein the second support includes a second threaded female connecting member, wherein the rod is movable horizontally between a first position, wherein the rod is nested in the hollow rail, and a second extended position, wherein the first and second connecting members are screw connected, and wherein the rod is longer than the opening formed between the first and second supports.

28. A sailboat railing, comprising:

a first vertical support on a sailboat deck;

a first hollow, horizontal rail supported by the first support;

a first rod received telescopically and rotatably within the hollow rail, wherein the rod has a free end with a first male threaded connecting member fixed internally to the free end and the free end is roughened externally;

a second vertical support on a sailboat deck and spaced from the first support to define an opening between the first and second supports, wherein the second support includes a second threaded female connecting member internally thereof, wherein the rod is movable linearly between a first position, wherein the rod is nested in the hollow rail, and a second extended position, wherein the first and second connecting members are removably screw connected, and wherein the rod is longer than the opening formed between the first and second supports.

* * * * *